United States Patent [19]

Nordstrom

[11] Patent Number: 5,038,549

[45] Date of Patent: Aug. 13, 1991

[54] STACKING PACKAGING MACHINE

[75] Inventor: John E. Nordstrom, 2408 Jefferson St., Two Rivers, Wis. 54241

[73] Assignees: John E. Nordstrom; Barbara A. Nordstrom, Two Rivers, Wis.

[21] Appl. No.: 334,656

[22] Filed: Apr. 6, 1989

[51] Int. Cl.[5] ..... B65B 11/06; B65B 35/52

[52] U.S. Cl. ..... 53/447; 53/230; 53/466; 53/535; 53/541; 414/794.9

[58] Field of Search ..... 53/228, 229, 230, 231, 53/232, 248, 535, 537, 538, 540, 541, 447, 466; 414/795.3, 795.2, 794.9

[56] References Cited

U.S. PATENT DOCUMENTS

| | | | |
|---|---|---|---|
| 2,768,489 | 10/1956 | Brown et al. | 53/447 X |
| 3,200,494 | 8/1965 | Grant | 53/228 |
| 3,585,777 | 6/1971 | Pesch | 53/540 X |
| 3,938,304 | 2/1976 | Utsumi | 53/229 |
| 4,060,957 | 12/1977 | Birkenfield et al. | 53/447 X |
| 4,426,025 | 1/1984 | Nordstrom | 53/209 X |
| 4,492,070 | 1/1985 | Morse et al. | 53/438 |
| 4,535,587 | 8/1985 | Rias | 53/447 X |
| 4,593,517 | 6/1986 | Mattila | 53/535 X |
| 4,679,379 | 7/1987 | Cassoli | 53/540 X |
| 4,796,409 | 1/1989 | Rimmer et al. | 53/447 X |

FOREIGN PATENT DOCUMENTS

| | | | |
|---|---|---|---|
| 129767 | 2/1978 | German Democratic Rep. | 53/540 |

*Primary Examiner*—John Sipos
*Assistant Examiner*—Linda B. Johnson
*Attorney, Agent, or Firm*—Wheeler Law Firm

[57] ABSTRACT

A stacking packaging machine and a process for stacking and packaging resilient workpieces. The workpieces are usually rolled paper products. The machine is comprised of an input conveyor, an elevator, cams, workpiece holders, a packaging film feeder and an output conveyor. A first group of workpieces is placed upon the elevator by the input conveyor and the elevator is lowered. The workpiece holders are brought into place. A second group of workpieces are fed into the holders and held above the first group. The elevator begins to rise and the second group of workpieces are released. The stacked workpieces rise on the elevator toward the output conveyor. Packaging film is fed over the stacked workpieces. The film drapes over the workpieces as they rise preventing any workpieces from falling off the stack. The workpieces enter the output conveyor and are moved to final processing. The timing of the whole sequence is controlled by the cams.

6 Claims, 5 Drawing Sheets

FLIGHT BAR TIMING

ELEVATOR & PRODUCT HOLDER TIMING

STACKING PACKAGING MACHINE

BACKGROUND OF THE INVENTION

The device of this invention relates to the field of packaging; specifically packaging soft rolled material such as toilet paper or paper toweling. The purpose of this invention is to provide a high speed means of wrapping and stacking a large quantity, for example, 12 rolls, of product in a package quickly and efficiently without damaging the surfaces of the product during the packaging process.

The applicant knows of no other invention which accomplishes what his invention accomplishes. Furthermore, the applicant's invention provides a high speed means by which a high quality finished wrapped product may be produced by means of a unique and simple design.

The applicant knows of no other prior art which accomplishes what his invention accomplishes or teaches what his invention requires U.S. Pat. No. 4,679,379 (Cassoli) discloses an automatic bundling machine. However the structure and the process used in the Cassoli patent is completely different from the structure and process used by the applicant. Cassoli requires that the workpieces be pushed by a piston through a resilient gate 28 into a chamber where the workpieces are stacked upon one another bottom to top. Once the desired number of units has been stacked, a second pusher 32 pushes the units or articles 12 forward into a transfer unit 33 shown in FIGS. 5 and 6 of the Cassoli patent. The products are compressed so a single roll of thermal multiple weldable material is bundled around them. The applicant's invention is structurally different from Cassoli, the applicant's process is different, and the applicant does not require compression of the articles in order for them to be wrapped. Furthermore, the applicant's invention accomplishes the wrapping of a rolled tissue product in fewer steps than does the Cassoli patent. U.S. Pat. No. 4,535,587 (Rias) discloses a method for stacking and interconnecting a plurality of partially compressed multi-rolled packages. This is completely different from the applicant's invention. Rias's patent deals with the stacking of already packaged rolls of compressible insulation. Rias discloses no structure or machinery which would indicate a method even similar to the applicant's method of stacking and packaging individual rolls of material. U.S. Pat. No. 4,492,070 (Morse, et al) discloses a case loading apparatus and method, however, the structure and method disclosed are different from those disclosed by the applicant. U.S. Pat. No. 4,426,025 (Nordstrom) discloses a high speed wrapping machine but no structure or method of stacking objects such as rolls of paper is disclosed in the patent. U.S. Pat. No. 4,060,957 (Birkenfeld, et al) discloses a method and apparatus for forming palletless packages. Again the structure of the invention and the method disclosed are completely different from the applicant's invention.

SUMMARY OF THE INVENTION

It is the objective of the applicant to disclose both a structure and a process by which materials, like those disclosed, may be stacked and packaged.

The purpose of the packaging machine is to package more than one horizontal row of soft paper materials, such as bathroom tissue or kitchen towels, to yield a package in which there are several rows of material front to back, side to side and vertically; this yields a package with a great many units in it. For instance, if the package holds two rolls front to back, three rolls side to side, and two rolls vertically the package includes a dozen rolls. Even larger packages are possible with this machine.

The basic design of the machine is an input conveyor on which one horizontal layer of rolls is gathered at a time and propelled by flight bars of the conveyor. For example, one layer might consist of two rolls from front to back and three rolls from side to side. The flight bars of the conveyor push a group of rolls forming one layer in the direction of their axes onto a vertically moveable horizontal platform. The size of the platform is sufficient to hold the rolls placed upon it by the input conveyor. The moment the rolls are on the platforms, they are lowered to a second position sufficiently below the input conveyor flight bars so that the second group of rolls supplied by the flight bars will come in sufficiently above the rolls already on the platform so that they do not touch the rolls that are already on the platform.

As the platform is lowered to the second position, a group of elements called product holders are brought into place on each side of the space where the platform was. These consist of bars extending parallel to the axes of the paper rolls. Each bar is long enough to contact the entire length of each roll of paper in an axial direction. One bar is above the center line of the paper rolls as they enter the space above the platform, one bar just below the center line and one bar substantially below the center line. The holders are brought into a position where the bars are each closer to the axes of the rolls than the actual diameter of the roll, so that the rolls must be squeezed into the space between the left product holder and the right product holder. As the conveyor pushes the group of rolls between the product holders they are compressed slightly so they are held above the previous group of rolls. This process is assisted by the fact that the end of each bar in the product holder has a ramp section extending at an angle away from the axes of the rolls so that the product is gradually compressed as the flight bar of the input conveyor pushes the products between the product holders.

Because the product rolls must squeeze between the right and the left sets of bars, and because the bars have spaces between them into which the soft paper on the product roll can expand, there is almost a splined connection between the product and the bars that contact it. This prevents the product from rotating. In addition, the fact that the lower-most bar is farther beneath the product than the others causes a slight upward thrust on the product that the bars engage, which rotates the roll of the product slightly; only a few degrees inward and upward. Where there are three or more rolls of the product abreast in the side to side direction between the product holders this engagement of the outer rolls with the product holder and the slight rotation of the outer rolls inward and upward supports the inner roll which does not contact the product holders. Accordingly, the inner roll cannot fall even though it does not touch the holders, the platform beneath, or the products on the platform beneath.

It is important to emphasize that as the second group of rolls of product squeezes between the product holders the first group of products on the platform are at a distance that is greater than one product diameter below the second group of products. As a result the second group of products will not touch the first group. The reason the products must not touch is that, being relatively soft, they could scuff each other and their appearance would be hurt. By supporting the products entirely between the smooth hard product holders during the time the products are pushed over the platform, scuffing or other damage to the product is avoided.

Once the second group of products is over the platform, the platform rapidly rises so that the first group of products supports the second group of products. Just before the first group of products touches the second group of products the product holders retreat, releasing the second group of product so that they may rise with the platform on top of the first group of products; the action of the product holders releasing and the platform rising occurs so quickly that the second group of products does not fall but moves with the first group of products.

While the upper group of products enters the product holders a conventional feeder for cut sheets of wrapping film has placed a sheet of film over the platform and products. The products on the platform rise into contact with that sheet. As the platform rises, with the layers of product on it, the sheet of wrapping material drapes over the sides of the layers of product. This draping process backed up by guides (not shown) prevents the rolls from moving during the brief period that they are rising on the elevator without the product holders engaged. An overhead output conveyor then takes the stacked products and a conventional tucking and folding mechanism finishes wrapping the film around the products. The products are moved along the output conveyor by a series of product grippers which clamp around the draped plastic that is over the product. This allows the supporting elevator to pull away, while at the same time a traveling tucker plate slides across, causing the bottom ends of the draped plastic sheet material to close thus preventing the product from falling down onto the elevator.

A conventional sealing mechanism secures the wrapper to form a finished package which typically contains 12 to 24 units of soft roll material.

It should be noted from this description that it would be possible to package additional layers of rolls of materials simply by allowing the platform to drop to a third position lower than the second position so that yet another layer of product could be brought into the product holders and then deposited on the platform. Side guides would be required to keep the products from rolling.

DETAILED DESCRIPTION

Figure 1:
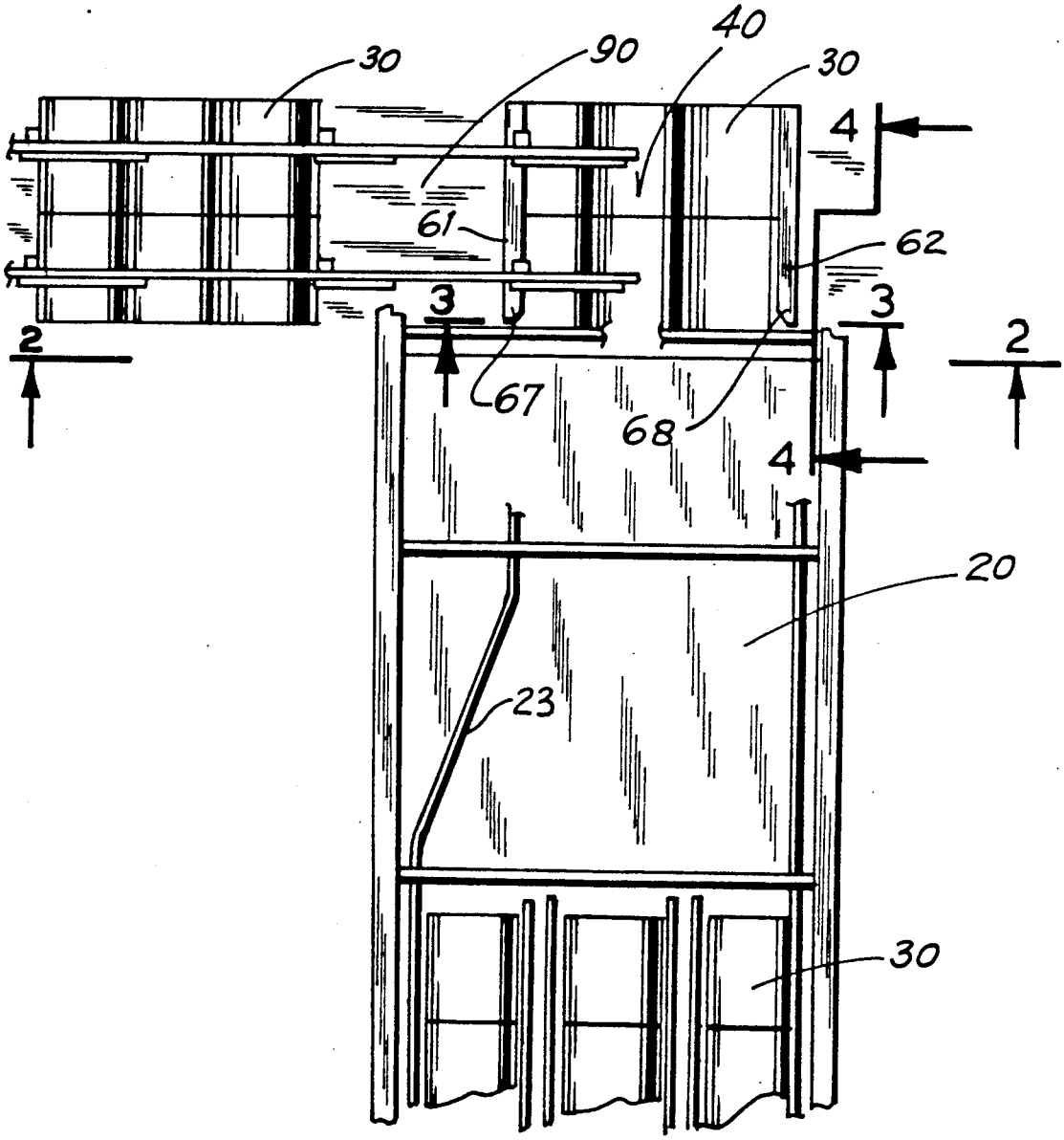
FIG. 1 is a top plan view of the input conveyor and the stacking packing machine.
Figure 2:
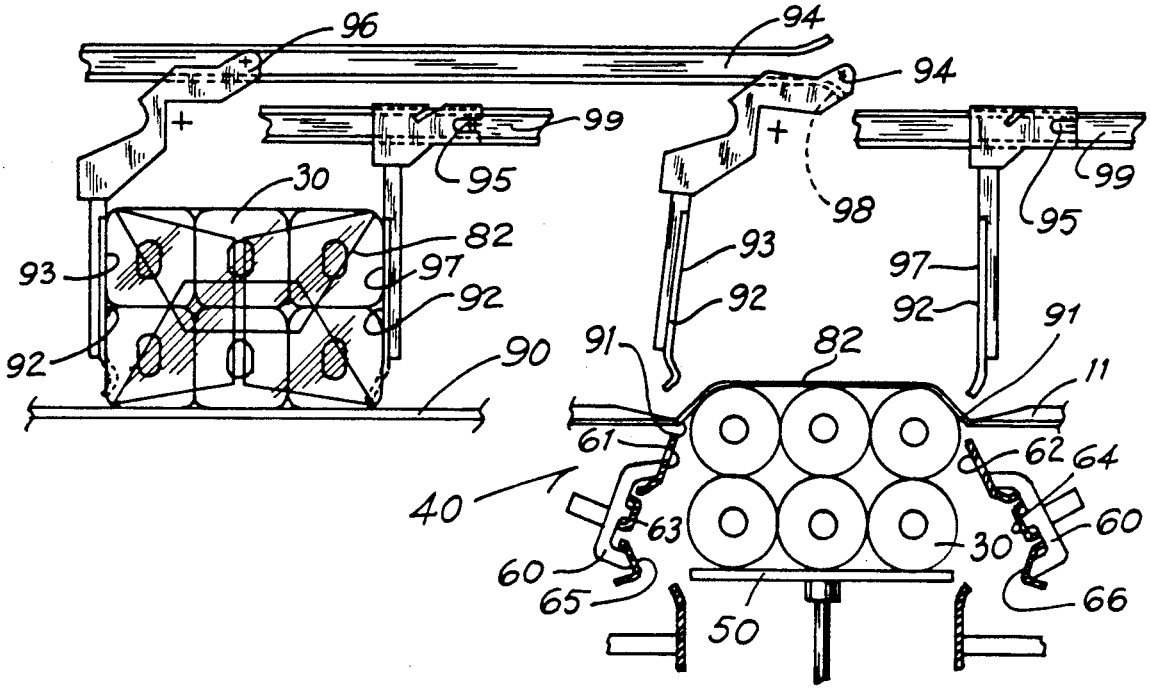
FIG. 2 is a view on line 2—2 of FIG. 1.

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

For purposes of simplicity the stacking and packaging machine in this description is generally referred to as the machine 10.

The machine 10 comprises an input conveyor 20, a stacking packaging area 40, an output conveyor 90, and a group of timing cams 100. The novelty of the invention lies in the design of the stacking packaging area 40 and the combination of that design with the timing provided by the cams 100. The cams 100 are conventional but are designed to conform to the timing disclosed in FIGS. 7 and 8 and are driven so that they are synchronized with the input conveyor 20 and the output conveyor 90.

Figures 6, 6A:
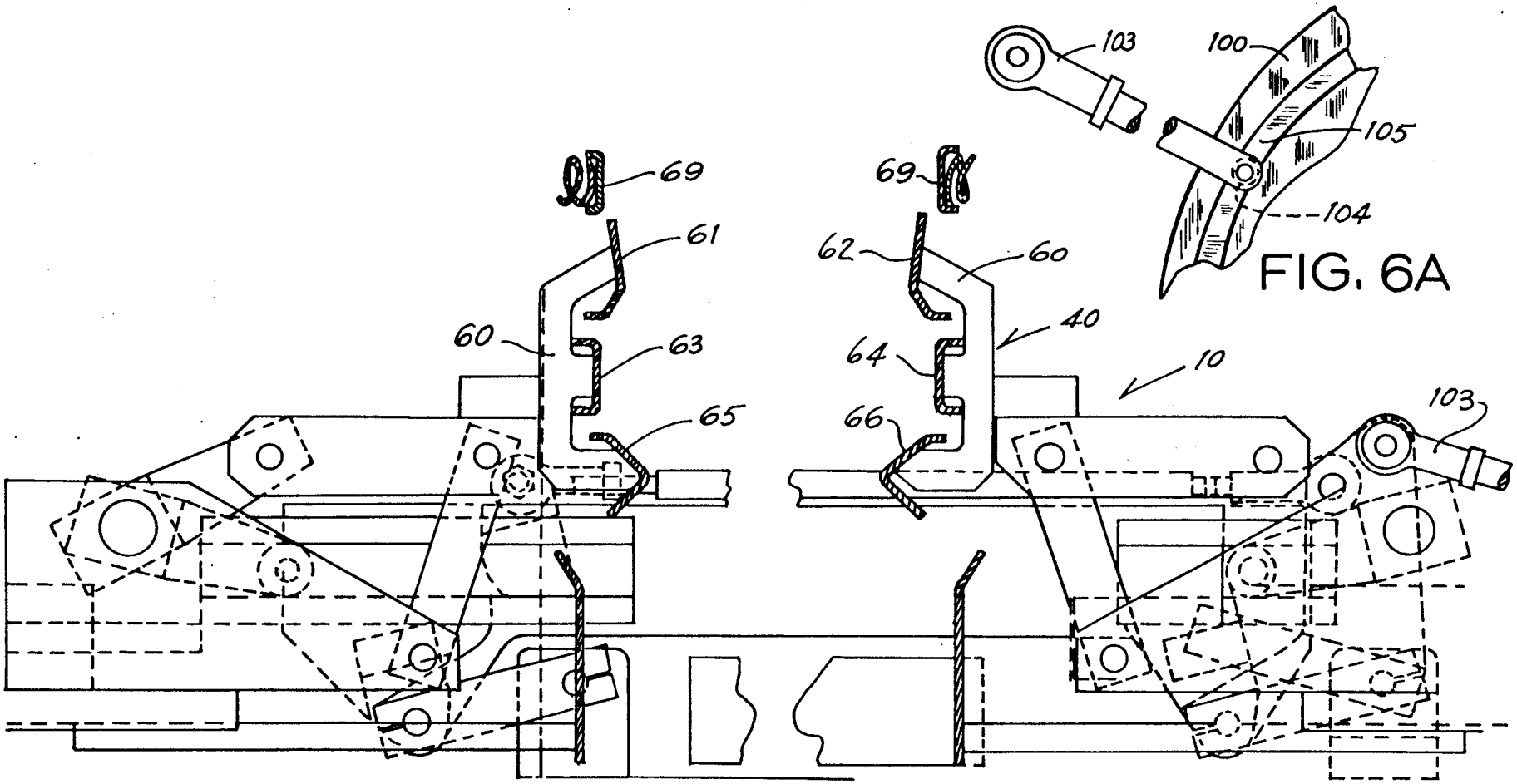
FIG. 6 is schematic view showing the direct mechanical linkages from the cams to the product grippers.
FIG. 6A is a fragmentary continuation of FIG. 6 showing a cam and follower.

Referring to FIG. 6, the input conveyor 20 comprises a chain 22, flight bars 21, and a guide bar 23. The output conveyor 90 comprises linear cams 94 and 99, cam followers 95 and 96, a ramp 98, and workpiece holding bars 92 carried on chains driven by sprockets 12 (not shown). The stacking packaging area 40 comprises an elevator 50 and workpiece holders 60 driven by cams 100, and a conventional packaging film feeder 80.

Figure 4:
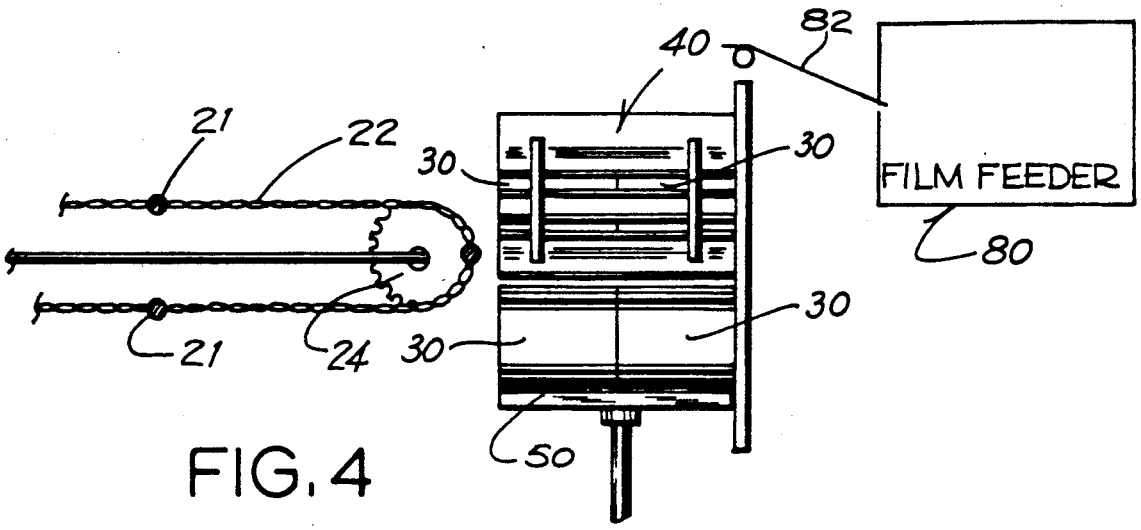
FIG. 4 is a view on line 4—4 of FIG. 1.
Figure 5:
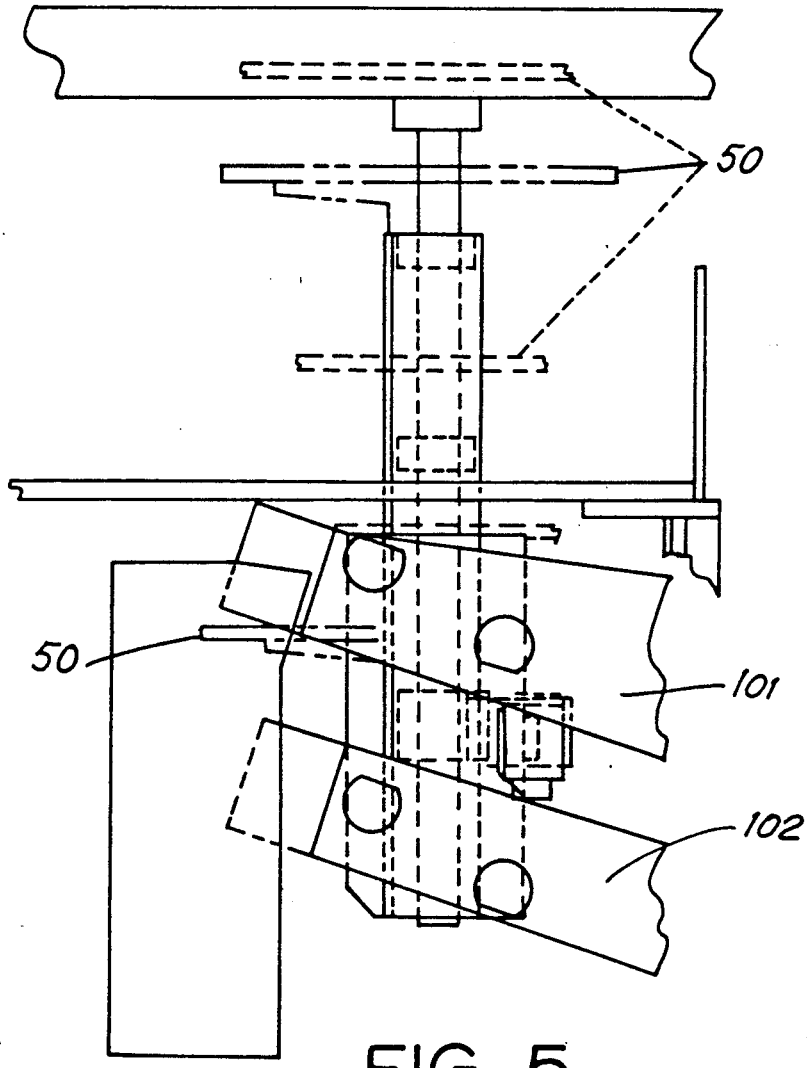
FIG. 5 is a schematic view showing the various levels or positions of the elevator during the stacking packaging process.

Referring to FIGS. 1 and 4, the rolled paper product, hereinafter referred to as the workpieces 30, may be seen being fed into the stacking packaging area 40 by the input conveyor 20. The chain 22 of the input conveyor 20 is driven by sprockets 24; track 24 is illustrated in FIG. 1. The chain 22 is attached to the ends of the flight bars 21. The inflow of workpieces 30 is relatively constant. However, because the number of workpieces 30 being fed to the input conveyor 20 can vary the arrival of workpieces 30 is detected by means of electric eyes 25 (not shown). The electric eyes 25 assure that the number of workpieces 30 between any two flight bars 21 remains constant by stopping the machine 10 if the number of workpieces 30 is incorrect. This allows the machine 10 to control the number of workpieces 30 that are between two adjoining flight bars 21 at any given moment. The guide bar 23 narrows the width of the input conveyor 20 near the end of its run, guiding the workpieces 30 into a channel that enables them to be easily fed into the stacking packaging area 40.

Figure 7:
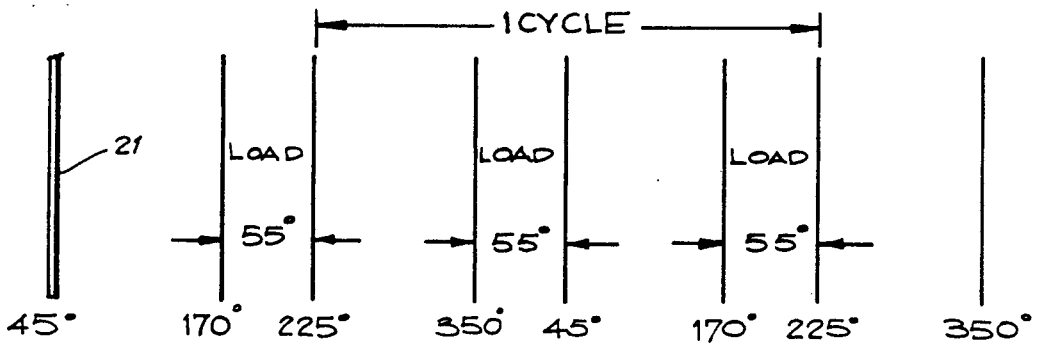
FIG. 7 is a chart of a timing cycle showing the cam timing to complete one cycle of stacking and packaging.
Figure 8:
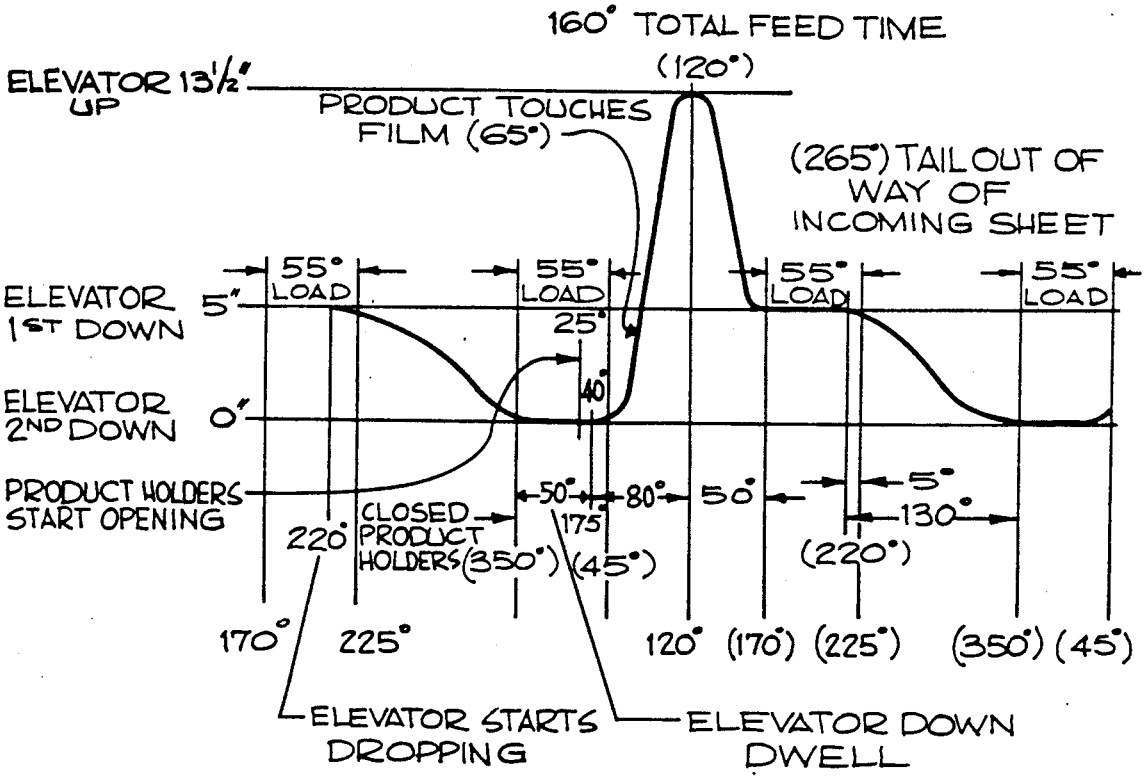
FIG. 8 is a timing chart showing graphically the cam timing and the functions of the elevator through a stacking packaging cycle.

The stacking packaging area 40 is illustrated in FIGS. 2, 3, 4, 5 and 6. The elevator 50 in the stacking packaging area 40 is initially at a level that is the same level as the input conveyor 20. A first group of workpieces 30 are pushed onto the elevator 50 by a flight bar 21. Referring to FIGS. 7 and 8, the cams 100 are in the 225° position. The elevator 50 is then lowered by cams 100 through cam follower links 101 and 102 to a second position in FIG. 3. This second position is also illustrated graphically in FIG. 8. The elevator 50 remains in the second position between 350° and 40° of the movement of the cams 100. At 350° movement, as shown in FIG. 8, the cams 100 through cam follower link 103 move the workpiece holders 60 from the position illustrated in FIG. 2 to the position illustrated in FIG. 3. Referring to FIG. 6A cam follower 104 of cam link 103 may be seen in groove 105 of one of the cams 100. A second group of workpieces 30 are then squeezed into the workpiece holders 60 by a flight bar 21.

Figure 3:
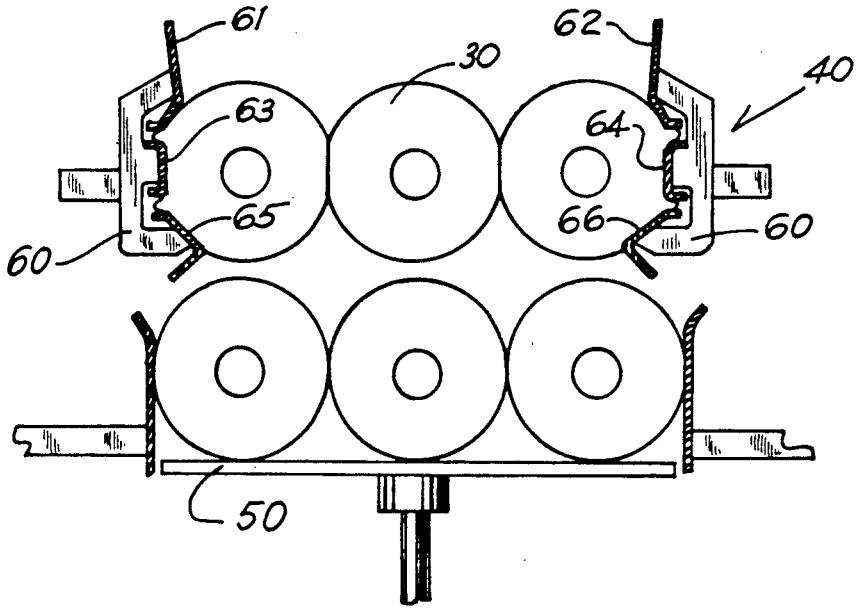
FIG. 3 is a view on line 3—3 of FIG. 1.

The workpiece holders 60 are essentially composed of six generally parallel bars 61–66, three on either side; refer to FIG. 3. The left ends 67 and right ends 68 of the bars 61–66 are slightly flared at the point where the workpieces 30 are squeezed into the holders 60; see FIG. 1. The flared ends 67–68 act as ramps which facilitate the process of squeezing the second group of workpieces 30 into the holders 60. Going from top to bottom the bars 61 and 62, may be seen to be above the horizontal center line of the workpieces 30 as they enter the space above the elevator 50. The middle or second set of bars, 63 and 64, are located just below the horizontal center line of the workpieces 30. Finally, the lowest set of bars 65 and 66 are located substantially below the horizontal center line of the work pieces 30. Also, the lowest set of bars, 65 and 66, are located closer to the center of the layer of workpieces 30 than the upper 61 and 62, or middle, 63 and 64, set of bars. Each bar is long enough to contact the entire length of each layer of workpieces 30.

FIG. 3 shows that the total distance between holders 60 and the respective sets of bars, one set being bar 62, 64, and 66 and the other set of bars being 61, 63, and 65, is smaller than the total distance across all of the work pieces to be held for one layer of stacked product and that the bars temporarily indent the soft workpieces. Because the workpieces 30 are soft material they can be squeezed between the bars 61–66. FIG. 3 illustrates the relationship of the surfaces of the workpieces 30 with the bars 61–66 of the holder 60. The squeezing of the bars 61–66 creates an almost splined connection between the bars 61–66 and the workpieces 30. This prevents the rotation of the outer workpieces 30. This means that all the workpieces 30, both inner and outer, are firmly held in place. This prevents the inner and outer workpieces 30 from popping out of the grippers 60. The fact that the lowest set of bars 65 and 66 are located, as FIG. 3 illustrates, closer to the center of the second layer of workpieces 30 than bars 61 and 62 or bars 63 and 64 means that the pressure of the squeeze of the bars 65 and 66 on the workpieces 30 is upward. This gives the workpieces 30 a slight upward impetus when the holder 60 releases the second layer of workpieces 30. Furthermore, the surfaces of the bars 61–66 are smooth and not abrasive; the surfaces of the bars 61–66 do not scratch or abrade the surface of the workpieces 30.

The holder 60 in conjunction with the elevator 50 allow the second layer of workpieces 30 to be brought over the first layer of workpieces 30 without the surfaces of either layer of workpieces 30 ever touching one another. This prevents the surface abrasion of the workpieces 30 that would otherwise occur when workpieces 30 of the second layer are pushed over the workpieces 30 of the first layer.

Once the holder 60 holds the second layer of workpieces 30 over the first set of workpieces 30 on the elevator 50, the elevator 50 begins to move upward; This is illustrated in FIG. 8 where the cams 100 have moved from 350° to 40°. Slightly before this, at approximately 25° of cam rotation, the holders 60 begin to release the second group of workpieces 30 causing there to be two layers of workpieces 30 on the elevator 50. Release is complete by 70° of cam rotation.

Sightly before but almost simultaneous with the release of the second layer of workpieces from the holders 60 a layer of film 82 has been fed over the top of the second layer of workpieces 30 from a conventional feeder 80. The workpieces 30 first touch the film 82 at 65° of cam movement; please see FIG. 8. The upward movement of the elevator 50 causes this sheet of film 82 to drape over the sides of the stacked workpieces 30. The film 82 is pulled over the sides of the workpieces 30 as the workpieces 30 are pushed upward by the elevator 50 through an opening 91 of the output conveyor 90 FIG. 2). The film 82 prevents the workpieces 30, which are stacked, from falling off of one another and holds them in place briefly while they are being pushed upward on the elevator 50. Once the elevator 50 reaches its maximum height, at 120° of cam movement, the output holding bars 92 of the output conveyor 90 grip the workpieces 30. The maximum height of the elevator 50 is equal to the level of the opening 91 of the output conveyor 90. Once the output holding bars 92 have gripped the workpieces 30 the elevator lowers again to its first position; see FIG. 2.

The workpieces 30 are gripped by the output holding bars 92 as a result of the timed action of the cams 100. The output holding bars 92 are divided into two groups 93 and 97. Group 97 are fixed bars against which the group 93 can gently squeeze the workpieces 30 and thus hold them as they move down the output conveyor 90. The group of bars 93 have cam followers 96 which travel up a ramp 98 and through a linear cam 94. This cam action is what causes the bars 93 to hold or squeeze the workpieces 30 against the bars 97; see FIG. 2.

Once the elevator 50 lowers, see FIG. 8, a traveler plate 11 immediately slides over the opening 91 pushing a portion of the film 82 over the bottom of the first group of workpieces 30. The output holding bars 92 then travel along their path. The output conveyor 90 then performs the standard folding and sealing operations that are common to the industry in finishing the packaging.

The entire described process above is controlled by conventional cam action. Cams 100 are connected by direct mechanical linkages to the elevator 50 and the product grippers 60; please see FIG. 5, 6 and 6A.

FIGS. 7 and 8 illustrate the cam timing which allows this unique cycle of packaging and stacking to occur. It is the cam timing that allows the stacking and packaging to occur at a rate which is very fast yet enables the machine 10 to prevent any abrasion of the workpieces 30 during the packaging and stacking process.

The above described embodiments of this invention are merely descriptive of its principles and are not to be limiting. The scope of this invention instead shall be determined from the scope of the following claims, including their equivalents.

It should be noted that in the following claims the terms "layer" and "group" can mean a single workpiece as well as a plurality of workpieces.

Process and structure are disclosed in the claims below.

What is claimed is:

1. A stacking packaging machine for stacking and packaging workpieces comprising:

film feeding means;

elevating means;

timing means;

supply means for supplying a plurality of workpieces;
workpiece holding means;
connection means for connecting said elevating means and said workpiece holding means to said timing means;
moving means for moving said elevating means and said workpiece holding means in concert with said timing means;
said workpiece holding means being located above said elevating means;
said elevating means having at least three vertically spaced positions: an intermediate first position, a lower second position and an upper third position;
said elevating means being capable of holding a plurality of said workpieces;
said workpiece holding means having at least two positions: a closed workpiece holding position and an open workpiece release position;
said workpiece holding means, being side support means for supporting the workpieces only by their sides and being capable of holding a plurality of said workpieces in said closed position after downward movement of said elevating means from said intermediate first position to said lower second position;
a first group of said workpieces being fed onto said elevating means at said first position by said supply means;
a subsequent group of said workpieces being fed into said workpiece holding means in said closed position by said supply means without contact with said first group of workpieces while said elevating means is in a said second position;
whereby said subsequent group of said workpieces over said first number of workpieces are stacked as said elevating means raises to said third position,
a sheet of packaging film is fed horizontally over said workpiece holding means by said film feeding means,
said film being wrapped around said stacked workpieces as said elevating means raises to said third position,
said first group of workpieces and said second group of workpieces never touching each other until said elevating means begins moving to its third position,
said plurality of workpieces being stacked and wrapped.

2. The device of claim 1 in which said elevating means is an elevator platform,
said timing means are cams, and said supply means is a continuous input conveyor.

3. The device of claim 1 in which said workpiece holding means comprises:
a plurality of bars;
said bars being matched in at least 2 sets;
each said set having an upper bar, an intermediate bar, and a third lower bar;
said bars extending in directions that are generally parallel to the longitudinal axes of said workpieces;
said workpieces having a central point;
said central point located at the center of the each said workpieces;
said bars being spaced;
said upper bars being located above said central points of said workpieces;
said intermediate bars being located at generally the same level of said central points of said workpieces;
said lower bars being located below said level of said central point of said workpieces;
each said set of bars being positioned so that when said workpiece holding means is in said closed position, the distance between said sets of said bars being smaller than the total width of all said workpieces to be held for one layer, each said bar being closer to the central point of each workpiece engaged by each said bar than the width of each said workpiece that said bars engage;
said workpiece holding means having a receiving end;
the ends of said bars located at said receiving end being slightly flared outward with respect to said work pieces;
said workpieces being fed into said holding means at said receiving end;
whereby the workpieces are squeezed into the space created by the workpiece holding means in its closed position and said flared ends of said bars acts as ramps that facilitate the squeezing of the rolls between the space created when the bars are in the closed position.

4. A process for stacking and packaging a plurality of workpieces comprising:
a first step in which a first group of workpieces are moved to a first position where they can be moved vertically;
at least one second step in which said first group of workpieces are lowered to another position;
at least one third step in which a subsequent group of workpieces are moved into said first position and said workpieces are supported only at their sides;
said first group not touching said subsequent group initially;
at least one fourth step in which at least one said subsequent group is released from said first position;
a fifth step in which said first group is raised toward and into contact with said subsequent group at a rate sufficient that said subsequent group does not move substantially toward said first group before said respective groups are in contact;
said subsequent group then being in contact with the top of said first group to form a stack of groups;
both said groups continuing to move upward in said vertical direction into contact with overlying packaging material;
a sixth step in which said packaging material drapes over the sides of both said groups;
a seventh step at which said workpieces stop moving upward and are moved to a final processing point;
whereby the workpieces are stacked and do not abrade each other.

5. In a stacking packaging machine, an input conveyor capable of supplying groups of product, flight bars on the input conveyor capable of pushing said product onto a platform, said platform being on a level with said input conveyor in a first position and dropping to a second position after it receives a group of said products from said input conveyor, said second position being far enough below said input conveyor so that a second group of said products fed over said platform do not touch said product already on said platform;
product holders, including side support means for supporting only the sides of the groups of product, being located on each side of said platform and brought into a holding position while said platform drops to receive said second groups of incoming products supplied by said input conveyor, the arrangement of said product holders being such that said product holders can support said incoming products without any support from said products previously placed on said platform by said input conveyor;

said platform being raised to a third position above said level at which said product arrives from said input conveyor after all of the layers of product have been placed over the platform;

said layers of product being wrapped;

whereby to raise all of the layers of rolls of product to a higher level, a wrapping film supply mechanism which feeds wrapping film over the products on the platform before the platform raises to a third position, means to fold the film around the product in the third position, and conveyor means to remove the product and the wrapper from the platform after the platform has risen to the third position and the film has been placed around the product.

6. In a stacking packaging machine, an input conveyor capable of supplying groups of product, flight bars on the input conveyor capable of pushing said product onto a platform, said platform being on a level with said input conveyor in a first position and dropping to a second position after it receives a group of said products from said input conveyor, said second position being far enough below said input conveyor so that a second group of said products fed over said platform do not touch said product already on said platform;

product holders, including side support means for supporting at least some of the sides of the groups of product, being located on each side of said platform and brought into a holding position while said platform drops to receive said second groups of incoming products supplied by said input conveyor, the arrangement of said product holders being such that said product holders can support said incoming products without any support from said products previously placed on said platform by said input conveyor;

said platform being raised to a third position above said level at which said product arrives from said input conveyor after all of the layers of product have been placed over the platform;

said layers of product being wrapped;

whereby to raise all of the layers of rolls of product to a higher level, a wrapping film supply mechanism which feeds wrapping film over the products on the platform before the platform raises to a third position, means to fold the film around the product in the third position, and conveyor means to remove the product and the wrapper from the platform after the platform has risen to the third position and the film has been placed around the product;

said product holders each consisting of a series of bars parallel to the longitudinal axes of said products, with spaces between said bars, the first said bar in each said product holder being located above the central longitudinal axes of said products, the second said bar being located slightly below said central axes of said products, and the third said bar being located substantially below said central axes of said products, so that the total distance between each said product holder is generally smaller than the total width of all said workpieces to be held for one layer;

whereby the product roll must be squeezed to enter the space between the product holder bars, and the ramps at the end of the bars to facilitate the squeezing of the rolls.

* * * * *